United States Patent [19]

Scaglia

[11] Patent Number: 4,798,154

[45] Date of Patent: Jan. 17, 1989

[54] COUPLING ELEMENT OF THE BOOM TO THE MAST OF A SMALL SAILING CRAFT

[76] Inventor: Enzo Scaglia, 20, Via Monterosa, Milan, Italy

[21] Appl. No.: 932,723

[22] Filed: Nov. 19, 1986

[30] Foreign Application Priority Data

Nov. 22, 1985 [IT] Italy ..... 23945/85[U]

[51] Int. Cl.[4] ..... B63B 15/00

[52] U.S. Cl. ..... 114/98; 114/39.2

[58] Field of Search ..... 114/39, 39.2, 89, 91, 114/97–99

[56] References Cited

U.S. PATENT DOCUMENTS 47,004 3/1865 Fisher ..... 114/97

298,545 5/1884 Bangs ..... 114/97

4,448,142 5/1984 Pollard ..... 114/39.2

FOREIGN PATENT DOCUMENTS 616374 3/1980 Switzerland ..... 114/98

*Primary Examiner*—Joseph F. Peters, Jr.

*Assistant Examiner*—Jesus D. Sotelo

*Attorney, Agent, or Firm*—Lerner, David, Littenberg, Krumholz & Mentlik

[57] ABSTRACT

The invention relates to a coupling element between the mast and the boom of a small sailing craft, comprising rotating supports mounted on the boom to constantly maintain a face thereof against the mast surface in whatever relative position. The boom can be fixed to the mast by a belt or strap.

14 Claims, 2 Drawing Sheets

Fig. 1
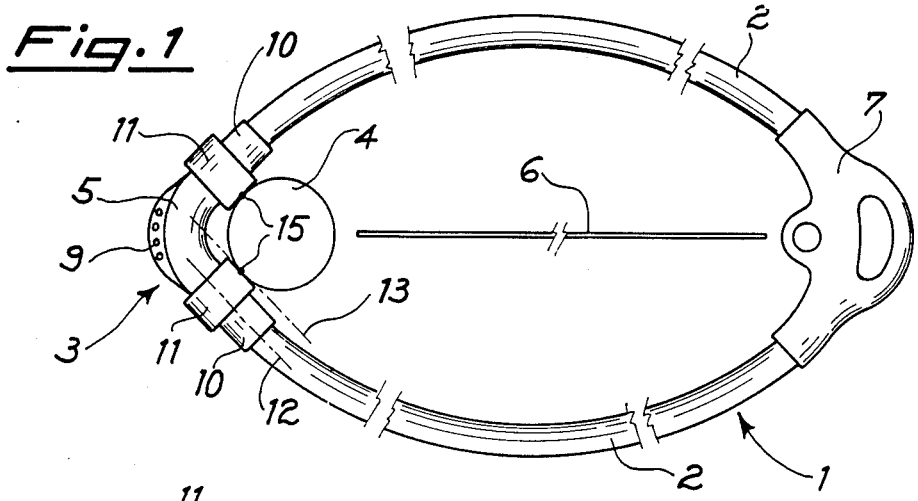
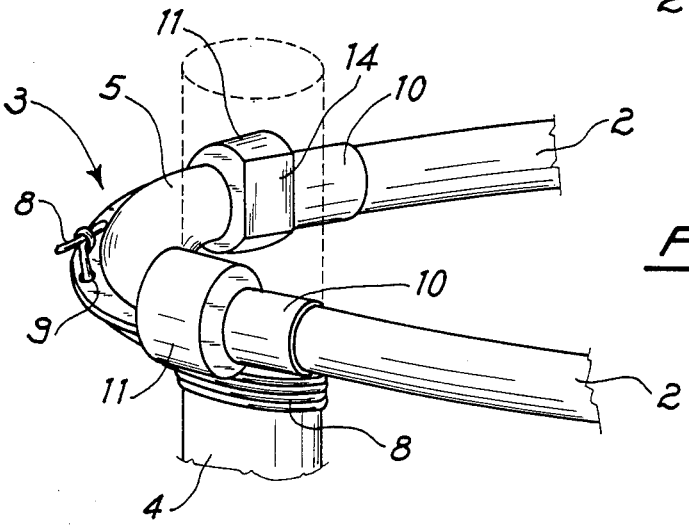
Fig. 2
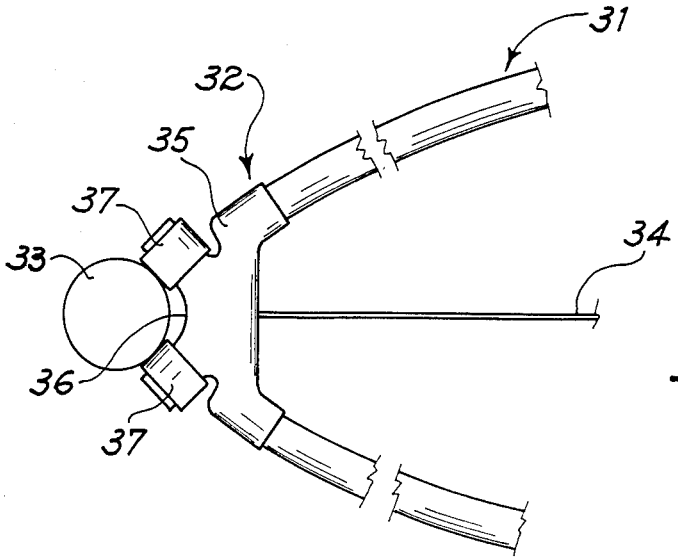
Fig. 3

COUPLING ELEMENT OF THE BOOM TO THE MAST OF A SMALL SAILING CRAFT

BACKGROUND OF THE INVENTION

The present invention relates to small sailing crafts in general and concerns a coupling element of the boom to the mast. Generally, the boom of small sailing crafts, and surf boards in particular, consists of two side-by-side tubes connected at their ends. The sail is inserted between the tubes and is fixed to the two ends of the mast and to one end of the boom. The other end of the boom has a coupling element to the mast and is maintained in the desired position by a binding. In particular, the boom can simply bear against the mast, being forced by the tension of the sail, or it can house the mast between the two tubes and be kept in contact with the coupling element by means of the said binding.

The the first case, the coupling element presents a fork on its outer edge adapted to house the mast, while in the second case the mast is housed in a cavity on the inner edge of the coupling element. In both cases, the area of contact between the coupling element and the mast consists of a concave cylindrical seating with should fit the mast perfectly and provide a large area of contact between the mast itself and the coupling element.

In reality, given that the position of the boom varies with the height of the user, the boom is not always perpendicular to the mast; in other cases, as the diameter of the mast is not standardized, it may happen that the mast does not enter the recessed area of the coupling element or there may be an excessive play between the mast itself and the seat.

In the first case, the contact between the mast itself and the boom is concentrated on a point with consequent rapid deterioration of the outer surface of the mast, while in the second case, the coupling of the mast and boom is unstable and the latter may tend to oscillate round its axis.

As stated above, the boom is fixed to the mast by means of a length of cord which is first wound round the mast and then fastened to the coupling element. The binding of the boom to the mast is generally effected placing the boom parallel to the mast, given that the coupling element is so shaped as to bring the binding into tension when the boom is brought into the working position. This movement of the boom, necessary to bring the binding into tension, is balanced by the friction forces generated by the movement of the coupling element on the surface of the mast.

DISCLOSURE OF THE INVENTION

An object of this invention is to provide a coupling element of the boom to the mast which eliminates the above-mentioned drawbacks of coupling elements known up to now, prevents point-contact between the boom and the mast, avoids any oscillation of the former about its own axis and facilitates to the maximum the movement of the boom to tension the binding.

Another object of the invention is to provide, in a boom-mast coupling element as described above, a practical and effective method of connecting these two structural elements together.

These objects are achieved by a coupling element presenting a concave seating to the mast, characterized in that, corresponding to the seating, there is an essentially cylindrical support mounted in a rotating manner to maintain its surface in contact with the mast whatever the coupling position of the boom and the mast.

In particular, the external circumferential surface of the support, where it bears against the mast, presents a flat section substantially tangential to a generatrix of the mast.

Preferably, the coupling element according to the invention consists of the two supports with their axes of rotation at an angle to each other and moving in the same plane which is substantially perpendicular to the axis of the mast.

Due to the two supports and in particular to the flat section of their external circumferential surface, the contact between the boom and the mast is always along two generatrices of the mast, independent of the diameter of the mast and of the angle the boom forms with the mast. Further, given that the supports are rotatable, the operation of rotating the boom from the position parallel to the mast, in which the binding is tied, and the working position is facilitated. Once the supports have been positioned so that their flattened surfaces are tangential to the mast, the rotation of the boom in the plane containing the axis of the mast occurs in the axis of rotation of the supports.

Always according to the invention, the mast can be tied by means of a strap whose ends are fastened to the boom in such a way as to form a loop in which the mast is held and locked.

The main features of the coupling element according to the invention are now described with reference to the attached drawings.

BRIEF DESCRIPTION OF THE DRAWINGS

FIG. 1 is a plan view of the coupling element fixed to a boom of the type housing the mast of the craft internally.

FIG. 2 is a three-dimensional view of the coupling element in FIG. 1.

FIG. 3 is a plan view of the coupling element fixed to a boom bearing against the mast.

DETAILED DESCRIPTION OF THE INVENTION

Figure 4:
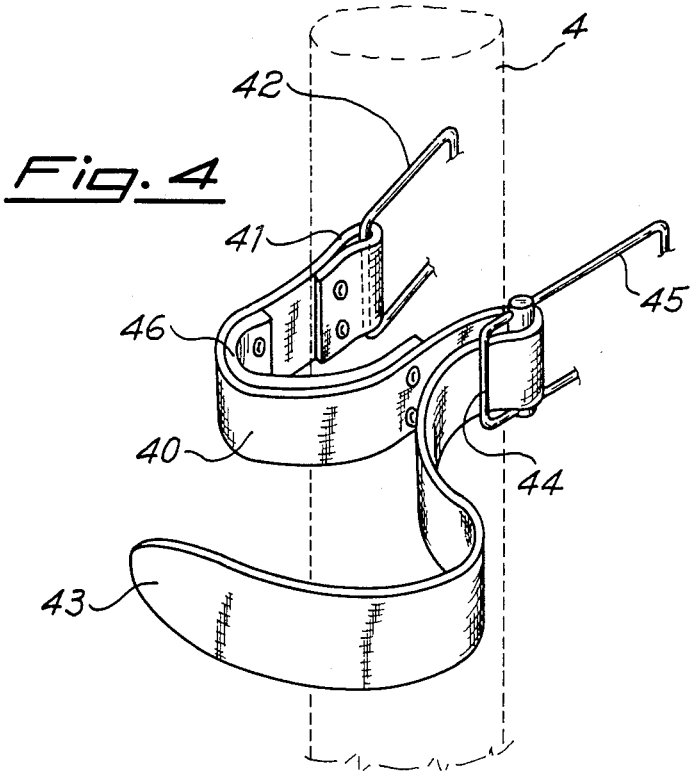
FIG. 4 is a three-dimensional partial view of a system of fixing the boom to the mast.

With reference to FIGS. 1 and 2, the boom 1 of a small sailing craft, e.g., a sail board, is formed by a pair of bowed tubes 2, placed side-by-side and fixed at their ends. The end 3 adjacent to the mast of the craft presents an element 5 which effects the coupling of the boom to the mast.

The sail 6 is deployed between the two tubes 2 comprising the boom, and is fastened to the two ends of the mast and to the free end 7 of the boom.

The boom illustrated in FIGS. 1 and 2 is of the type housing the mast internally, which bears against the internal part of the coupling element 5. The boom is tied to the mast by means of a binding 8 which keeps the coupling element 5 pressed against the external surface of the mast.

The coupling element 5 is formed by a "U" shaped coupling sleeve in plastic into whose ends are fitted the tubes 2 constituting the boom.

At its apex, the coupling element 5 has a series of through holes 9 which constitute anchorages for a binding 8.

On each of the two arms 10 of the coupling element 5, a rotating cylindrical support 11 is mounted, with its axis of rotation 12 substantially parallel to the tangent 13 of the mast 4 at the point of contact between the support itself and the mast.

The external circumferential surface of the support 11 presents a flattened surface to rub against the mast 4. In greater detail, the flattened sections 14 of the supports ensure that the contact with the mast, whatever its diameter and the position relative to the boom, will occur along the line of the mast, the two contact lines 15 being shown in FIG. 1.

Further, the fact that the contact between the supports and the mast occurs along two lines prevents the boom from turning on its own axis.

Where the diameter of the mast is standardized, the flattened surfaces 14 of the supports could, advantageously, be made concave to mate with the external surface of the mast.

As stated above, the supports 11, being rotating, allow the rotation of the boom in the plane of the axis of the mast, facilitating the movement of the boom from the position parallel to the mast in which the binding 8 is tied, to the working position and the tensioning in this position.

In FIGS. 1 and 2, the coupling element according to the invention is applied to a boom of the type housing the mast internally, but it is obvious that it could be applied to the type bearing against the mast externally.

With reference to FIG. 3, the boom 31 is forced with its end 32 against the mast 33 of the craft by the tension of the sail.

The sail 34, fixed to the end of the mast 33 and the free end of the boom, keeps the boom pressed against the mast. A coupling element 35 with a concave seating 36 is fixed to the end 32 of the boom for the partial housing of the mast. Corresponding to the seating 36 are mounted two rotating cylindrical supports 37 with their external circumferential surfaces in contact with the surface of the mast.

As in the case of the coupling element in FIGS. 1 and 2, the external circumferential surfaces of the supports 37 present a flattened section in contact with the surface of the mast so that the contact between the boom and the mast, independent of the diameter of the mast and of the position of the boom in the plane containing the mast axis, will be along the two generatrices of the mast.

Figure 5:
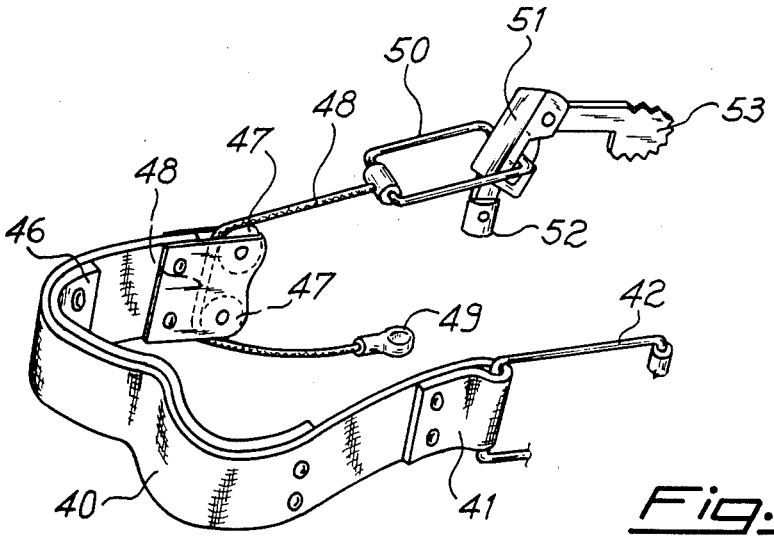
FIG. 5 is a three-dimensional partial view of an alternative system.

FIGS. 4 and 5 show an alternative to the classic system of fixing the boom to the mast. The fixing is effected by means of a flexible belt 40 which is attached by one end 41 to a link 42 attached to the boom on one side of the mast 4. The free end 43 of the belt (FIG. 4) is engaged in a buckle 44 on a second link 45 fixed to the boom on the other side of the mast. A rubber strip 46 or some other non-abrasive material could be fixed to the inside of the belt.

Another embodiment of the invention in FIG. 5 shows the link 42 on the other side of the mast from FIG. 4, while the other end of the belt 40 carries one or two pulleys 47, through which runs a flexible cable 48, one end 49 of which is fixed to the boom and the other is locked by means of the link 50 to the through-the-centre locking clamp 51, itself fixed to the boom at 52 and fitted with a safety locking hook 53.

I claim:

1. Apparatus for connecting the boom to the mast in a sailing craft which comprises a coupling member secured to the boom and having a seating section for receiving a portion of the mast; at least one predominantly cylindrical support for the mast, the cylindrical support being rotatably attached to the coupling member adjacent the seating section and having a substantially flat surface constantly in contact with the mast whatever the coupling position of the mast and the boom.

2. An apparatus according to claim 1 wherein the predominantly cylindrical support comprises a pair of predominantly cylindrical supports rotatably attached to the coupling member having their axes of rotation at an angle to each other and being substantially disposed in a plane perpendicular to the axis of the mast.

3. An apparatus according to claim 1 further including a binding for pivotably securing the mast to the boom.

4. An apparatus according to claim 3 wherein the binding is a flexible belt having a first end attached to the boom by a link and a second end locked to the boom on the other side of said mast.

5. An apparatus according to claim 4 wherein a portion of the flexible belt intermediate of said first and second ends is in contact with the mast, said portion having an anti-abrasive internal lining.

6. An apparatus according to claim 4 wherein said second end of the flexible belt is locked to the boom by means of a solid connection or buckle fastened to the boom.

7. An apparatus according to claim 4 wherein said second end of the flexible belt is locked to the boom by means of a locking clamp mounted on the boom.

8. Apparatus for connecting the boom to the mast in a sailing craft which comprises a coupling member secured to the boom and having a seating section for receiving a portion of the mast; at least one predominantly cylindrical support for the mast, the cylindrical support being rotatably attached to the coupling member adjacent the seating section and having a substantially concave surface which mates with a portion of the external surface of the mast and is constantly in contact with the mast whatever the coupling position of the mast and the boom.

9. An apparatus according to claim 8 wherein the predominantly cylindrical support comprises a pair of predominantly cylindrical supports rotatably attached to the coupling member having their axes of rotation at an angle to each other and being substantially disposed in a plane perpendicular to the axis of the mast.

10. An apparatus according to claim 8 further including a binding for pivotably securing the mast to the boom.

11. An apparatus according to claim 10 wherein the binding is a flexible belt having one end attached to the boom by a link and the other end locked to the mast.

12. An apparatus according to claim 11 wherein that portion of the flexible belt in contact with the mast has an anti-abrasive internal lining.

13. An apparatus according to claim 11 wherein the locking end of the flexible belt is locked to the mast by means of a solid connection or buckle fastened to the mast.

14. An apparatus according to claim 11 wherein the locking end of the flexible belt is attached to the boom by means of a locking clamp mounted on the boom.

* * * * *